US005657910A

United States Patent [19]

Keyser

[11] Patent Number: 5,657,910

[45] Date of Patent: Aug. 19, 1997

[54] SAFETY SEAL FOR SPRAY DISPENSING CONTAINER

[76] Inventor: Robert O. Keyser, 102 Aura Lea Boulevard, North York, Ontario, Canada, M9M 1K5

[21] Appl. No.: 622,195

[22] Filed: Mar. 25, 1996

[51] Int. Cl.[6] ..... B65D 47/34

[52] U.S. Cl. ..... 222/382; 222/383.1; 222/542

[58] Field of Search ..... 222/321.7, 382, 222/383.1, 464.1, 542

[56] References Cited

U.S. PATENT DOCUMENTS

| | | | |
|---|---|---|---|
| 3,587,940 | 6/1971 | Ellis | 222/542 X |
| 3,655,096 | 4/1972 | Easter | 222/382 X |
| 3,685,739 | 8/1972 | Vanier | 222/383.1 X |
| 3,952,918 | 4/1976 | Poitras et al. | 222/321.7 X |
| 4,154,369 | 5/1979 | Morane | 222/382 X |
| 4,230,277 | 10/1980 | Tada | 222/383.1 X |
| 4,241,853 | 12/1980 | Pauls et al. | 222/383.1 X |
| 4,821,923 | 4/1989 | Skorka | 222/382 X |
| 5,072,860 | 12/1991 | Dobbs et al. | 222/542 |
| 5,337,928 | 8/1994 | Foster et al. | 222/542 X |
| 5,423,460 | 6/1995 | Thomann | 222/382 |
| 5,507,418 | 4/1996 | Dobbs et al. | 222/542 X |

*Primary Examiner*—Kevin P. Shaver
*Attorney, Agent, or Firm*—Reed Smith Shaw & McClay

[57] ABSTRACT

The present invention features a safety seal for a liquid spray dispensing assembly consisting of a sprayer mechanism and a container. A typical spray dispensing assembly has a container with a threaded cylindrical neck defining a container opening, and a sprayer mechanism with a pump mounted onto a threaded cap and a dip tube which extends into the container when the cap is threadedly secured to the neck of the container. Liquid is drawn from the container through the dip tube by operating the pump. The safety seal has a flange portion, a first sealing portion and a second sealing portion. The flange portion is insertable into the cap for contact with the rim of the neck when the cap is secured to the exterior surface of the neck. The flange retains the seal within the container opening. The first sealing portion extends from the flange and provides a frictional circumferential seal with the interior surface of the neck adjacent the neck rim. The second sealing portion is disposed across the container opening when the safety seal is placed into the opening, and provides an aperture for sealing engagement with the dip tube. The safety seal is resistant to the effects of vibration or other factors that would cause a backing-off or negative rotation of the cap portion of the sprayer mechanism with respect to the neck portion of the container to which it is secured.

15 Claims, 4 Drawing Sheets

SAFETY SEAL FOR SPRAY DISPENSING CONTAINER

FIELD OF THE INVENTION

The present invention relates generally to spray dispensing containers for various liquids such as solvents, cleaning solutions, non-aerosols, and the like. More specifically, the invention relates to a safety seal for preventing leakage during storage, transport or use of such containers.

BACKGROUND OF THE INVENTION

Spray dispensing containers such as plastic bottles having removable "trigger" or "pump" type sprayer mechanisms have to date been increasingly adopted as a packaging solution for various liquid products. Such spray dispensing containers are both refillable and reusable, and have accordingly found success in terms of their market acceptance by retailers, consumers and other end users.

Typically, a sprayer mechanism for the spray dispensing container will be mounted to a cap for threaded or similarly secured engagement of the sprayer with the liquid container. The cap is often threadedly affixed to the corresponding exterior surface of a neck on the container which defines the container opening or mouth. Unfortunately, such containers, once filled with liquid and assembled with a sprayer mechanism, are at times prone to leakage at the threaded engagement between the sprayer cap and the container neck. This results in product loss and in soiling of labels. In the case of toxic or corrosive liquids, a potential risk to packagers, handlers, shippers, consumers and the environment may also ensue. Regardless of how securely or tightly the threaded engagement is made between the sprayer cap and exterior surface of the container neck, vibration of the container during transport of filled and assembled spray dispensing containers often results in "backing-off", namely in negative rotation or loosening of the threaded cap of the sprayer mechanism with respect to the container neck to which it is affixed. This phenomenon, where sufficiently pronounced, will cause the contained liquid to leak.

The response of the packaging industry to the leakage problem described above has produced a number of solutions, many of which are unsatisfactory. For instance, an adhesive or sealing compound may be applied to fix the threaded engagement between the dispenser mechanism cap and container. However, this solution typically renders the container non-refillable. As well, some manufacturers choose to transport or market filled liquid containers with a separately packaged spray dispenser, such that the consumer or end user is required to assemble the container and dispenser after purchase by removal of a foil or other seal from the opening on the container neck. Such a solution, while effective in preventing leakage, has proven unpopular with consumers due to the required post-sale assembly and poses packaging problems for the manufacturer or shipper who must bundle two separate items together. Yet another solution to the leakage problem is that of wrapping a filled container and spray dispenser assembly with a leak-proof covering, such as shrink-wrapped plastic film. While this solution may prevent leakage of the contained liquid into the surroundings during transport, it may not entirely prevent leakage from the container to within the wrapping itself.

It has also been known in the prior art to provide for sealing mechanisms for spray dispensing liquid containers. For instance, U.S. Pat. No. 3,587,940, issued on Jun. 28, 1971 in the name of Ellis, teaches a conversion kit adapter for liquid dispensers. The kit is said to permit the use of various ejector pumps on cans or receptacles having different kinds of mouths, and is said to provide an airtight seal. The sealing mechanism of the kit is comprised of a multi-part assembly. One of the parts consists of a resilient split ring washer disposed within a threaded cap of the sprayer mechanism. The split ring washer is said to provide sealing engagement with the upper surface of a laterally projecting flange provided around a collar portion of the spray mechanism. The lower surface of the said flange is described as sealingly engaging with another part of the sealing mechanism, namely a resilient retainer ring also disposed within the cap. The retainer ring provides a conical depending guide for the dip tube or pipette of the spray mechanism.

There are a number of problems or shortcomings associated with the sealing mechanism as taught by the Ellis patent referred to above. First, the sealing mechanism is adapted for sprayer mechanisms having a collar portion with a laterally projecting circumferential flange, and does not appear to be suitable for other collar geometries which do not provide such a flange. Second, the teachings of Ellis do not address the leakage problem caused by "backing-off" of the threaded sprayer cap from the container neck to which it is engaged. This is due to the fact that sealing engagement according to the Ellis teachings is achieved when the various parts of the sealing mechanism, namely the split ring washer and resilient retainer ring, are pressed together against the collar portion of the sprayer mechanism as the cap in which they are disposed is screwed onto the neck of the receptacle. Thus, any backing-off of the sprayer cap and container neck engagement would be expected to compromise the effectiveness of the multi-part sealing mechanism as taught by Ellis.

Accordingly, it is an object of the safety seal according to the present invention to address the problem of post-production leakage from spray dispensing containers.

SUMMARY OF THE INVENTION

The present invention provides a safety seal for a liquid spray dispensing assembly of the type having a liquid container and a sprayer mechanism that is removably secured to the container. The container typically includes a neck portion which defines the container opening. The neck portion has an interior surface within the container, a rim and an exterior surface outside the container. The sprayer mechanism has a liquid pump with a cap portion that is removably secured to the exterior surface of the neck portion of the container. The sprayer mechanism further has a dip tube which extends into the container for drawing liquid from the container by means of the pump of the sprayer mechanism. The container is filled with liquid to a predetermined filling level thereof.

According to a broad aspect of the present invention, the safety seal comprises a flange portion, a first sealing portion and a second sealing portion. The flange portion is insertable into the cap portion for contact with the rim of the neck portion of the container, when the cap portion is secured to the exterior surface of the neck portion. The flange portion retains the safety seal within the container opening. The first sealing portion extends from the flange portion, and provides frictional circumferential sealing engagement with the interior surface of the neck portion of the container. The second sealing portion is disposed across the container opening and above the liquid filling level when the safety seal is placed into the opening, and provides an aperture for sealing engagement with the dip tube of the sprayer mechanism when the dip tube is introduced through the aperture.

With respect to preferred embodiments of the present invention, the first sealing portion of the safety seal is of a generally cylindrical shape and has a top terminal end and a bottom terminal end, with the top terminal end being adjacent to the flange portion and the second sealing portion being adjacent the bottom terminal end. Alternatively, the second sealing portion may also be provided adjacent the top terminal end of the first sealing portion of the safety seal.

Preferably, the second sealing portion of the safety seal is of a generally planar shape. Where the second sealing portion is of a generally planar shape and is provided adjacent the flange portion, the second sealing portion is preferably substantially co-planar with the flange portion. Alternatively, the second sealing portion may be of a generally conical shape. According to this alternative embodiment, the second sealing portion may extend towards an apex thereof in a direction either away from the flange portion or towards it.

In further preferred embodiments, the flange portion of the safety seal is annular.

Advantageously, the flange portion, the first sealing portion and the second sealing portion of the safety seal together may be of unitary construction. Preferably, the safety seal may be manufactured from a plastic material which may be flexible and resilient, such as a low density polyethylene material.

Other features and advantages of the present invention will become apparent from the detailed description of the invention and embodiments thereof which is set out herebelow.

BRIEF DESCRIPTION OF THE DRAWINGS

For a better understanding of the present invention and to show more clearly how it may be carried into effect, reference will now be made, by way of example and not of limitation, to the accompanying drawings in which.

DETAILED DESCRIPTION OF THE INVENTION

Figure 1:
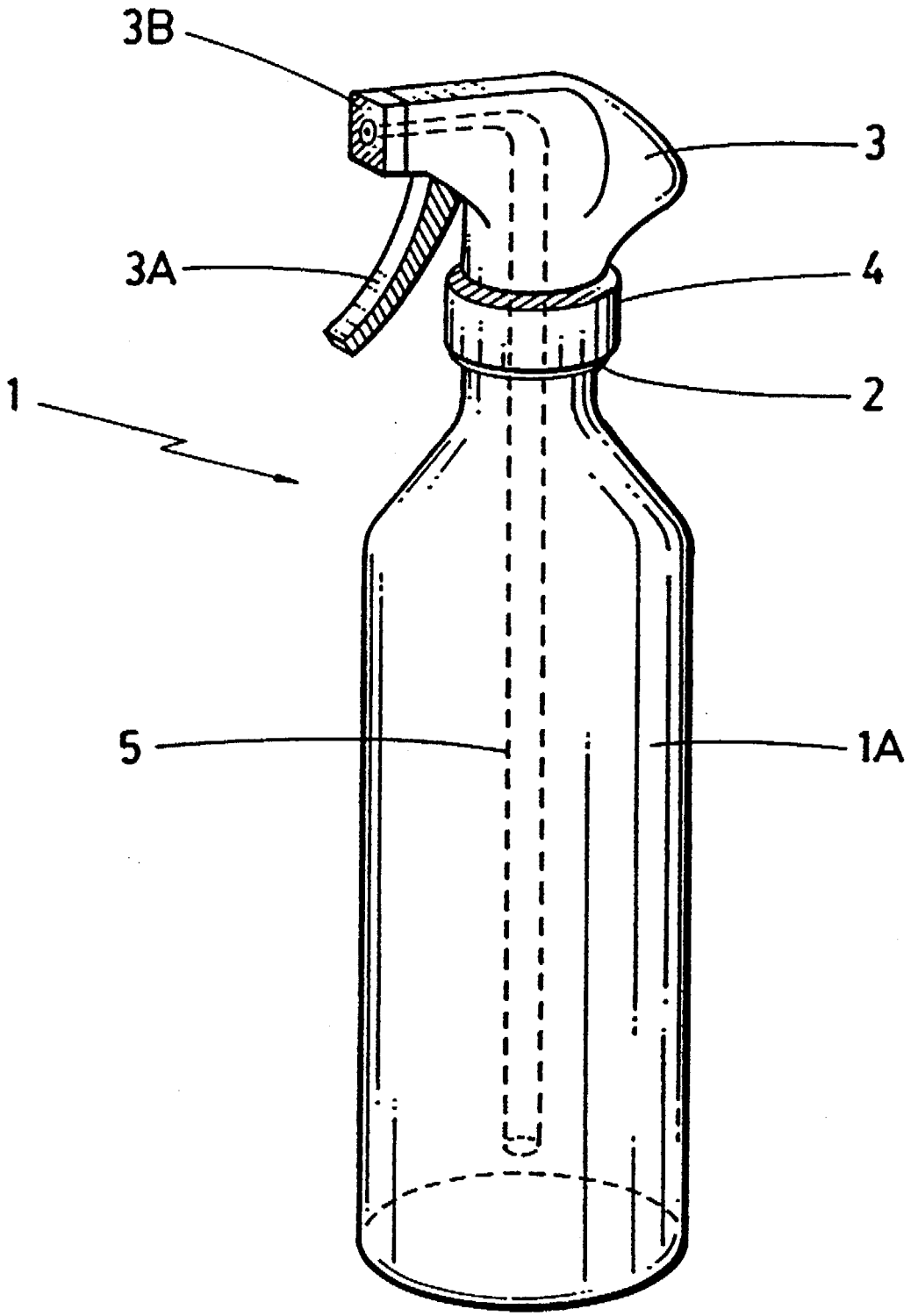
FIG. 1 is a perspective view of a spray dispensing container, with the cap of the sprayer mechanism thereof being represented in phantom lines to show the threaded engagement of the cap with the exterior surface of the container neck portion.

With reference to the drawings, FIG. 1 shows a liquid spray dispensing assembly 1 consisting of a typical trigger spray bottle. The assembly 1 provides a container 1A and a sprayer mechanism 3. The container 1A has a neck portion 2 which defines a container opening 1B. The neck portion 2 has an interior surface 2A within the container, a rim 2B and an exterior surface 2C outside the container, which exterior surface is threaded. The sprayer mechanism 3 is provided with a liquid pump (not shown) of a design well-known to those skilled in the art, and with a cap 4 which is removably secured in threaded engagement with the exterior surface 2C of the neck 2. Sprayer mechanism 3 also provides a pipette or dip tube 5 which extends into the container 1A, for drawing liquid therefrom by means of said pump. In the illustrated example, the pump is actuated by a trigger 3A. Other means of actuating the pump will be apparent to those skilled in this art. As the pump is actuated, a spray, stream or jet of liquid will be expelled from the nozzle 3B of the sprayer mechanism 3. In the event the cap 4 of liquid spray dispensing assembly 1 becomes loosened by vibration, the threaded engagement between the cap and threaded exterior surface 2C of the neck portion 2 no longer provides an effective seal, thereby resulting in the potential for leakage or spillage.

Figure 2:
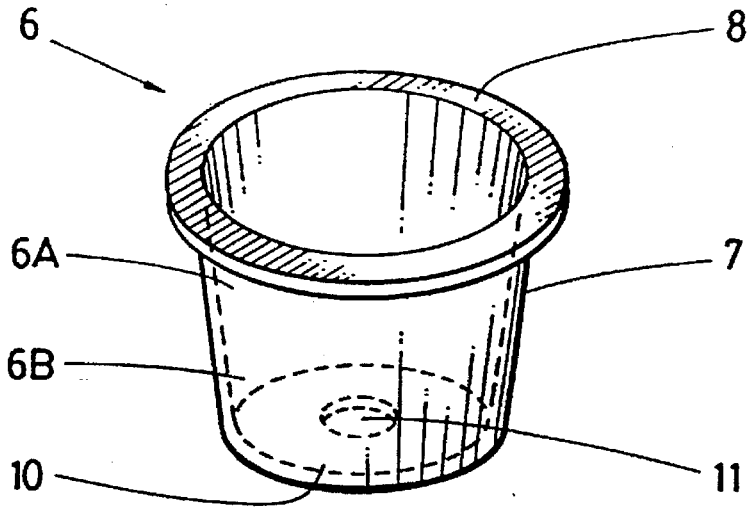
FIG. 2 is a perspective view of the safety seal according to one embodiment of the present invention.
Figure 3:
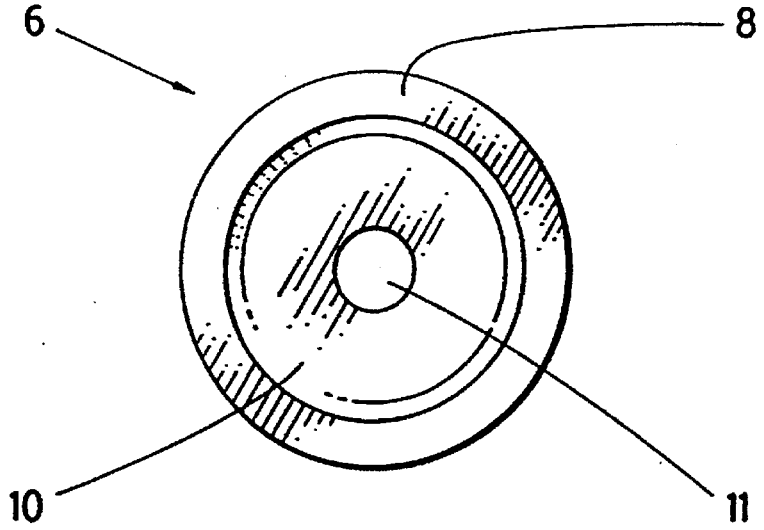
FIG. 3 is a top view of the safety seal of FIG. 2.
Figure 4:
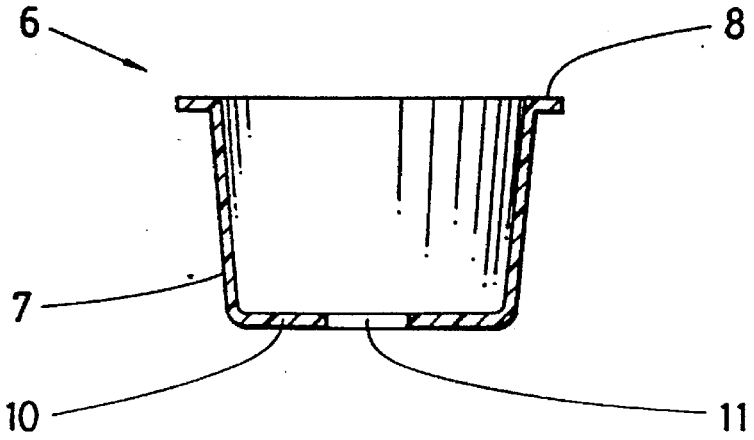
FIG. 4 is a side view, partially in cross-section, of the safety seal of FIGS. 2 and 3.
Figure 5:
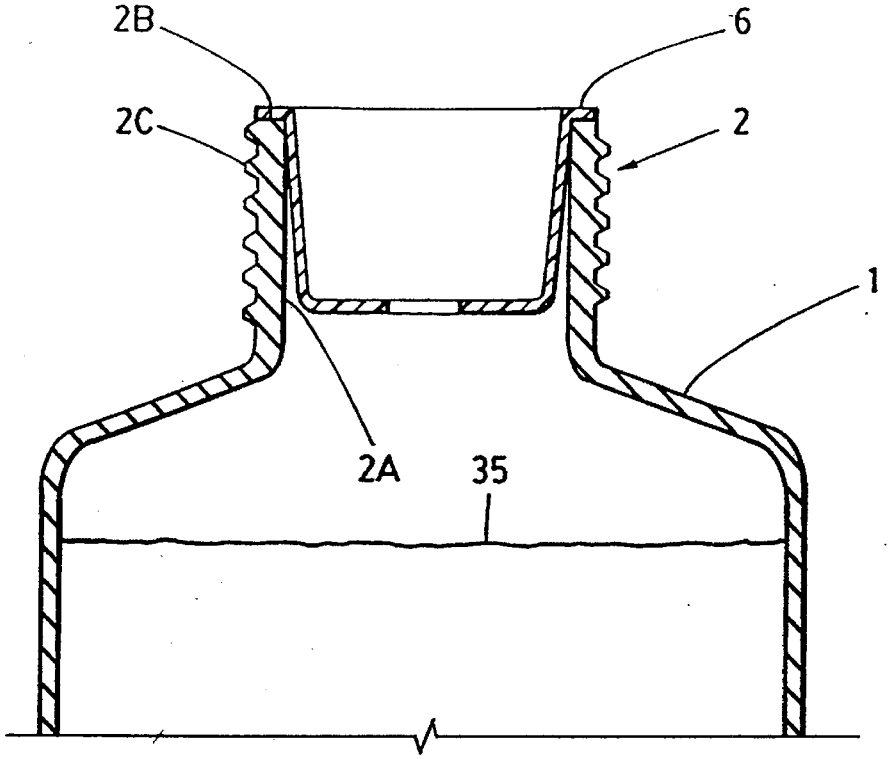
FIG. 5 is a combined cross-sectional and perspective view of the safety seal of FIGS. 2 through 4, as received into the container opening defined by the container neck portion.
Figure 5A:
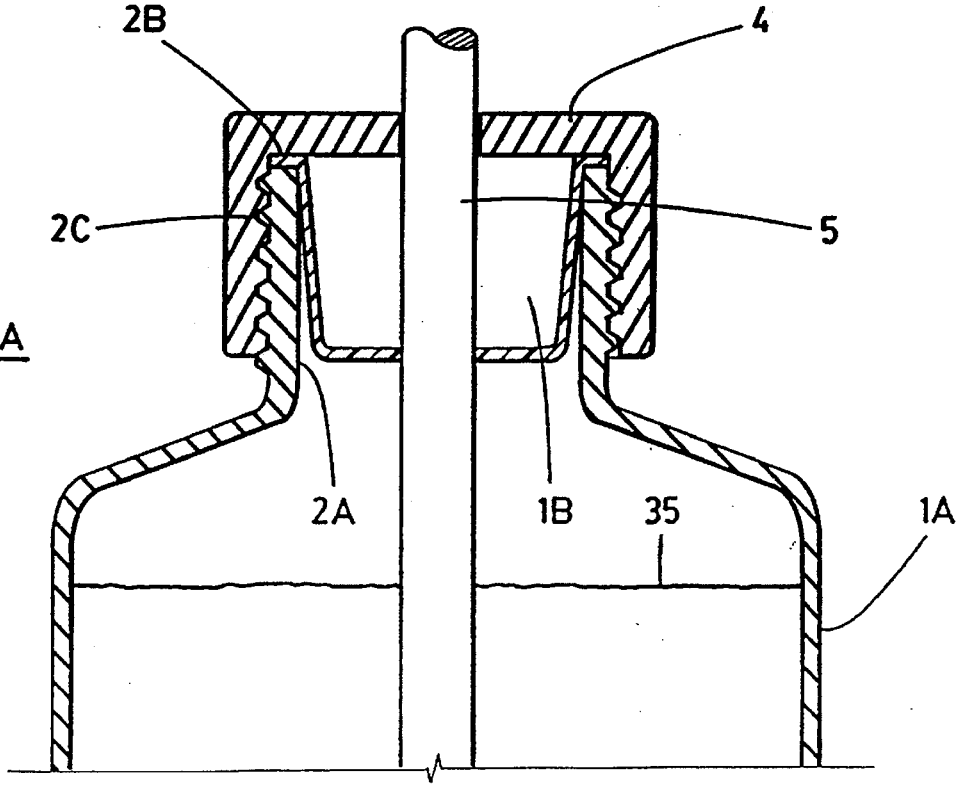
FIG. 5A is a detailed schematic cross-sectional view of the safety seal of FIGS. 2 through 4, placed into the container opening defined by the neck portion of a spray dispensing container assembly, and showing the relationship of the seal with the cap portion and dip tube of a sprayer mechanism.

FIGS. 2 through 4 show various views of a first embodiment of a safety seal for use with a liquid spray dispensing assembly of the type shown in FIG. 1. The safety seal 6 has a flange portion 8, preferably an annular flange, which is insertable into the cap portion 4. When the cap portion 4 is secured to the exterior surface 2C of the neck 2, the flange portion 8 contacts the rim 2B, as shown in FIG. 5A. The flange portion 8 retains the seal 6 in position within the container opening 1B, and prevents the seal from further descending into the container when placed within the container opening.

The seal provides a first sealing portion 7, preferably of a generally cylindrical shape, which extends from the flange portion 8. The first sealing portion is of a sufficient diameter to be frictionally retained within the container opening so as to provide a sealing engagement with the interior surface 2A of the neck portion, as shown in FIGS. 5 and 5A.

The safety seal 6 also provides a second sealing portion 10, preferably of a generally planar shape. The second sealing portion is disposed generally across the container opening 1B when the seal is placed thereinto and above the predetermined filling level 35 of the contained liquid, as shown in FIG. 5A. An aperture 11 is provided in the second sealing portion of a sufficient diameter to provide for sealing engagement with the dip tube 5 of the sprayer mechanism 3 when the dip tube is introduced therethrough, as shown in FIG. 5A.

Figure 6:
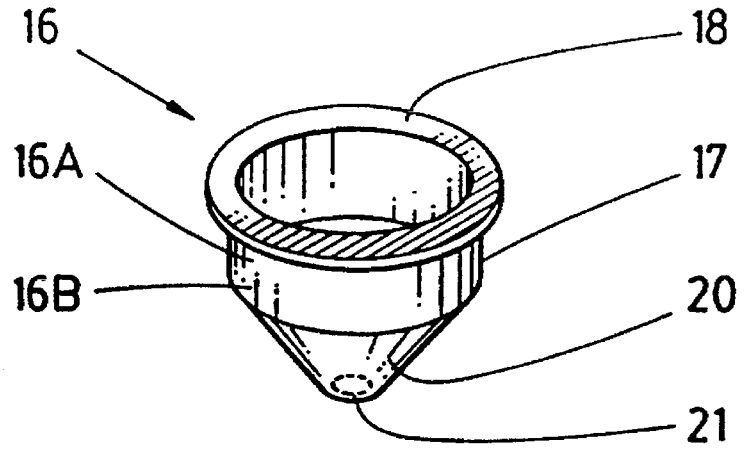
FIGS. 6 and 7 are perspective views of the safety seal according to other embodiments of the invention.
Figure 7:
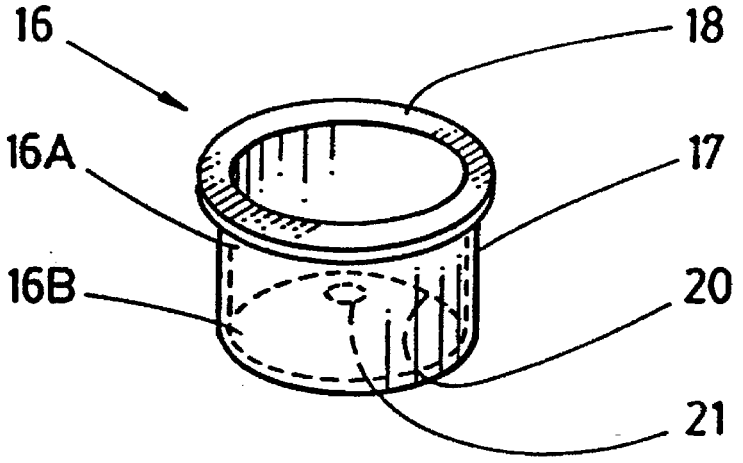

With regard to FIG. 2, the first sealing portion 8 and the second sealing portion 10 of the safety seal according to the first embodiment described above are respectively provided adjacent the top terminal end 6A and bottom terminal end 6B of the safety seal. In the alternative embodiments of the invention shown in FIGS. 6 and 7, the safety seals 16 likewise provide for a second sealing portion 20 adjacent the bottom terminal end 16B of the first sealing portion 17 of each seal. In these embodiments, the second sealing portion 20 is of a generally conical shape. In the case of the embodiment of FIG. 6, the conical shape extends towards an apex thereof in a direction away from the flange portion 18. In the case of the embodiment of FIG. 7, the conical shape extends towards an apex thereof in a direction towards the flange portion 18. In each case, an aperture 21 is provided at the apex of the conical portions, which aperture is of a diameter sufficient to provide for sealing engagement with dip tube 5, as previously explained.

Figure 8:
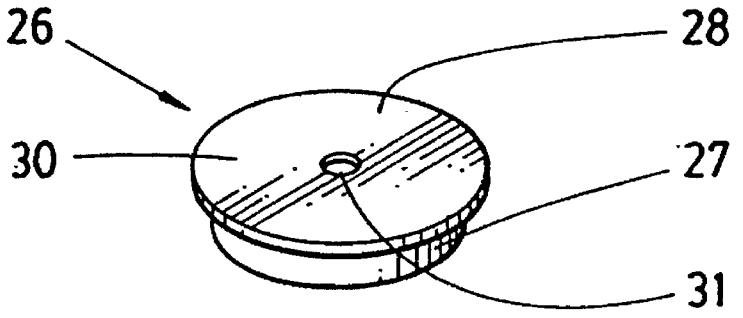
FIG. 8 is a perspective view of the safety seal according to yet another embodiment of the invention.

FIG. 8 shows yet another embodiment of the invention, wherein the safety seal 26 provides a first sealing portion 27 and a second sealing portion 30 having a dip tube aperture 31. The second sealing portion 30 is located at a top terminal end of the first sealing portion 27 adjacent the flange portion 28, and is co-planar therewith.

Preferably, the safety seal may be constructed from a plastic material which is flexible and resilient, such as a low density polyethylene. Advantageously, the flange portion, the first sealing portion and the second sealing portion of the safety seal together may be of unitary construction as may be obtained, for instance, by injection molding techniques well known to those skilled in this art. Other materials and fabrication techniques will be apparent to those persons skilled in this field of art.

In use, the safety seal according to the present invention is inserted within the container opening 1B after the container has been filled or refilled with liquid. The flange portion 8 of the seal will retain the seal against the rim 2B of the container neck 2, and will prevent the further insertion of the seal into the container opening. The dip tube 5 of the sprayer mechanism 3 is then introduced through aperture 11 of the second sealing portion 10, while ensuring that no liquid has inadvertently seeped or splashed past the aperture 11 prior to the introduction of the dip tube. The dip tube is fed into the container 1A until the cap portion 2 of the sprayer mechanism comes into contact with the neck portion 2 of the container, whereupon the cap is threaded onto the exterior surface 2C of the neck portion and is tightened thereagainst. The flange portion 8 of the seal, being insertable into the cap, acts as a washer disposed between the cap and the rim 2B of the neck, thereby further securing the engagement therebetween.

The safety seal of the present invention provides several advantages over the prior art solutions mentioned previously. Given that the first sealing portion of the seal is in frictional engagement with the interior surface of the container neck portion, the effectiveness of the safety seal is not wholly dependent on the steadfastness of the cap and neck engagement, and the seal is therefore resistant to the effects of vibration or other factors that would cause a backing-off or negative rotation of the cap portion of the sprayer mechanism with respect to the neck portion of the container to which it is removably secured. Moreover, the functioning of the spray dispensing container assembly remains unaffected by the provision of the safety seal within the container opening, and no post-purchase assembly is required of a consumer or end user when the seal is provided in a pre-packaged liquid dispenser.

The foregoing description of the invention is made with reference to the preferred embodiments thereof. However, those skilled in this art will appreciate that the principles of the present invention may be applied to a variety of other embodiments of safety seals for liquid spray dispensing container assemblies. For example, many sprayer mechanisms, particularly of the "pump" type, have a spring assembly axially disposed within an area of increased diameter of the pipette or dip tube. The safety seal, in such an embodiment, may have a sufficiently elongate first sealing portion so as to accommodate the spring assembly and engage the pipette below the spring assembly. As well, the surface of the first sealing portion of the safety seal may be provided with one or more circumferential ribs to frictionally and sealingly engage the interior surface of the container neck. Many other variations and modifications of detail could be made to the described embodiments, without departing from the scope and spirit of the present invention. Therefore, the present invention should be considered as limited only by the scope of the following claims and equivalents thereof.

What is claimed is:

1. A safety seal for a liquid spray dispensing assembly of the type having a liquid container and a sprayer mechanism removably secured thereto, the container comprising a neck portion defining a container opening, the neck portion having an interior surface within said container, a rim and an exterior surface outside said container, the sprayer mechanism comprising a liquid pump with a cap portion removably secured to the exterior surface of the neck portion of the container, the sprayer mechanism further comprising a dip tube extending into said container for drawing liquid therefrom by means of said pump, the container being filled with liquid to a predetermined filling level thereof, the safety seal comprising:

(a) a flange portion insertable into said cap portion for contact with the rim of the neck portion when said cap portion is secured to the exterior surface of the neck portion, the flange portion constituting means for retaining said safety seal within said container opening;

(b) a first sealing portion extending from said flange portion, the first sealing portion constituting means for frictional circumferential sealing engagement with the interior surface of the neck portion; and (c) a second sealing portion being disposed across said container opening and above said filling level when said safety seal is placed into said opening, the second sealing portion providing an aperture therein for sealing engagement with said dip tube when introduced therethrough.

2. The safety seal according to claim 1, wherein the first sealing portion is of a generally cylindrical shape having a top terminal end and a bottom terminal end, the top terminal end being adjacent said flange portion, and wherein the second sealing portion is provided adjacent said top terminal end.

3. The safety seal according to claim 2, wherein the second sealing portion is of a generally planar shape.

4. The safety seal according to claim 3, wherein said second sealing portion is substantially co-planar with the flange portion.

5. The safety seal according to claim 1, wherein the first sealing portion is of a generally cylindrical shape having a top terminal end and a bottom terminal end, the top terminal end being adjacent said flange portion, and wherein the second sealing portion is provided adjacent said bottom terminal end.

6. The safety seal according to claim 5, wherein the seal is made of a flexible, resilient material.

7. The safety seal according to claim 5, wherein the safety seal is made of a plastic material.

8. The safety seal according to claim 7, wherein the seal is made of low density polyethylene.

9. The safety seal according to claim 5, wherein the second sealing portion is of a generally conical shape, extending towards an apex thereof in a direction away from said flange portion.

10. The safety seal according to claim 5, wherein the second sealing portion is of a generally conical shape, extending towards an apex thereof in a direction towards said flange portion.

11. The safety seal according to claim 5, wherein the second sealing portion is of a generally planar shape.

12. The safety seal according to claim 11, wherein the flange portion is annular.

13. The safety seal according to claim 12, wherein the flange portion, the first sealing portion and the second sealing portion together are of unitary construction.

14. The safety seal according to claim 12, wherein the cap portion is threadedly secured to the exterior surface of the neck portion of the container.

15. A liquid spray dispensing assembly including the safety seal according to claim 1.

* * * * *